United States Patent [19]

Matsuda et al.

[11] Patent Number: 4,474,615

[45] Date of Patent: Oct. 2, 1984

[54] DIAPHRAGM FOR ELECTROLYSIS AND METHOD FOR PRODUCTION THEREOF

[75] Inventors: Itsuaki Matsuda; Tadao Takase, both of Yokohama, Japan

[73] Assignee: Showa Denko K.K., Tokyo, Japan

[21] Appl. No.: 396,503

[22] Filed: Jul. 8, 1982

[51] Int. Cl.[3] ..... C25B 13/08

[52] U.S. Cl. ..... 204/296; 204/295

[58] Field of Search ..... 204/295, 296; 106/DIG. 3; 501/3

[56] References Cited

U.S. PATENT DOCUMENTS

| | | | |
|---|---|---|---|
| 3,001,571 | 9/1961 | Hatch | 428/292 |
| 4,184,939 | 1/1980 | Kadija | 204/252 |
| 4,207,164 | 6/1980 | Kadija | 204/253 |
| 4,289,601 | 9/1981 | Kadija | 204/296 |

FOREIGN PATENT DOCUMENTS 56-84492 7/1981 Japan .

*Primary Examiner*—John F. Niebling

*Attorney, Agent, or Firm*—Sughrue, Mion, Zinn, Macpeak and Seas

[57] ABSTRACT

An improved diaphragm for electrolysis, said diaphragm being composed of a fibrous base material of asbestos or a mixture of asbestos and fluorine-containing fibers and existing in the interstices of said base material, a water-swellable micaceous mineral represented by the following general formula $$W_{\frac{1}{3}-1.0}[X_{2.5-3.0}(Z_4O_{10})F_2]$$

wherein W is Na and/or Li, X is Li and/or Mg, Z is Si and/or Al, O is oxygen and F is fluorine. The diaphragm can be produced by dispersing a fibrous base material of asbestos or a mixture of asbestos and fluorine-containing fibers in an aqueous slurry of the water-swellable micaceous mineral being partly in the form of a sol or in a mixture of it with an aqueous solution of sodium hydroxide and/or sodium chloride, forming the dispersion into a sheet, and drying the sheet.

3 Claims, 1 Drawing Figure

DIAPHRAGM FOR ELECTROLYSIS AND METHOD FOR PRODUCTION THEREOF

FIELD OF THE INVENTION

This invention relates to a diaphragm for use in the diaphragm-method electrolysis of an aqueous solution of sodium chloride, and a method for its production. More specifically, it pertains to a diaphragm suitable for the diaphragm-method electrolysis of an aqueous solution of sodium chloride which makes it possible to produce an aqueous solution of sodium hydroxide of a high concentration without reducing the current efficiency, and to a method for its production.

DESCRIPTION OF THE PRIOR ART

Asbestos has been used widely as a material for diaphragms for use in the diaphragm-method electrolysis of an aqueous solution of sodium chloride. Such diaphragms are produced, for example, by bonding an asbestos paper to a cathode substrate, or by depositing asbestos fibers onto a porous plate or wire gauze as a cathode substrate. These asbestos diaphragms, however, have the defect that within several hours in the initial stage of electrolysis, they become considerably swollen and have low dimensional stability, and moreover, they cannot increase the concentration of sodium hydroxide on the cathode side.

In an attempt to remove these defects, there have been proposed a method which involves treating the anode side of a diaphragm with a water-soluble silicate (U.S. Pat. Nos. 3,847,762 and 3,932,208), and a method which comprises heat-treating an asbestos diaphragm in the presence of an alkali metal to form an alkali metal silicate, and then depositing the asbestos onto a diaphragm (U.S. Pat. No. 3,939,055). Certainly, the diaphragms obtained by such methods have increased dimensional stability, but are not free from the defect that the current efficiency is reduced markedly at a high NaOH concentration.

On the other hand, it was proposed to impregnate a fibrous material (e.g., polytetrafluoroethylene, polypropylene, etc.) other than asbestos fibers with a non-fibrillating active substance containing silica which serves as a substitute for a gel layer formed in an asbestos diaphragm (Japanese Laid-Open Patent Publication No. 61081/1979 corresponding to U.S. patent application Ser. No. 836,636 filed Sept. 26, 1977 now U.S. Pat. No. 4,184,939, and Japanese Laid-Open Patent Publication No. 47388/1980 corresponding to U.S. patent application Ser. No. 947,235 filed Sept. 29, 1978 now U.S. Pat. No. 4,207,163). Such a method is unable to remove the defect that the current efficiency is reduced at a high NaOH concentration.

SUMMARY OF THE INVENTION

It is an object of this invention to obtain a diaphragm which can give a solution to the aforesaid problems of the prior art.

More specifically, it is an object of this invention to provide a diaphragm characterized by having a steady thickness, giving sodium hydroxide of a high concentration, and not reducing the current efficiency, and a method for its production.

According to this invention, there is first provided an improved diaphragm for electrolysis, said diaphragm being composed of a fibrous base material of asbestos or a mixture of asbestos and fluorine-containing fibers and existing in the interstices of said base material, a water-swellable micaceous mineral represented by the following general formula $$W_{\frac{1}{3}\text{-}1.0}[X_{2.5\text{-}3.0}(Z_4O_{10})F_2]$$

wherein W is Na and/or Li, X is Li and/or Mg, Z is Si and/or Al, O is oxygen and F is fluorine.

The invention also provides a method for producing the aforesaid improved diaphragm, which comprises dispersing the aforesaid fibrous base material in an aqueous slurry of the aforesaid water-swellable micaceous mineral in which at least a part of the micaceous mineral is dispersed in the form of a sol, forming the dispersion into a sheet, and drying the sheet.

The invention further provides a method for producing the aforesaid improved diaphragm, which comprises preparing a uniform dispersion of the aforesaid fibrous base material in a mixture of an aqueous slurry of the aforesaid water-swellable micaceous mineral in which at least a part of the micaceous mineral is dispersed in the form of a sol and an aqueous solution of sodium hydroxide and/or sodium chloride, forming the dispersion into a sheet, and then drying the sheet.

BRIEF DESCRIPTION OF THE ACCOMPANYING DRAWING

The drawing is a graph showing the relation between the current efficiency (%) at the cathode and the concentration (g/liter) of sodium hydroxide.

DETAILED DESCRIPTION OF THE INVENTION

Figure 1:
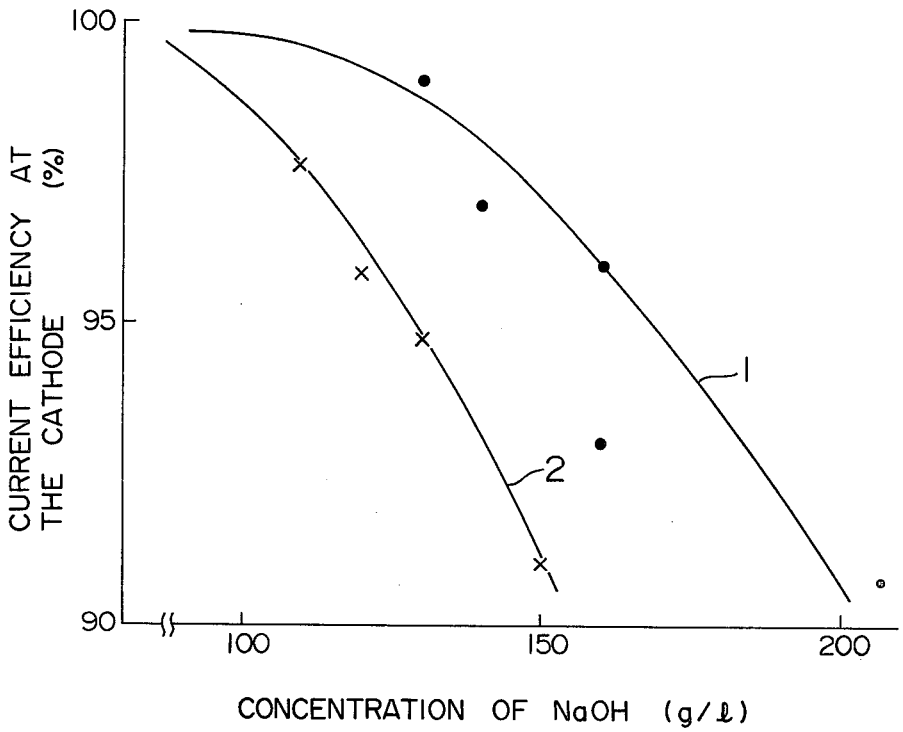

The fibrous base material used in this invention is composed of asbestos or a mixture of asbestos and fluorine-containing fibers. The fluorine-containing fibers, as used herein, denote fibers of polymers or copolymers of vinyl fluoride-type monomers such as $CF_2{=}CF_2$, $CHF{=}CF_2$, $CH_2{=}CF_2$ and $CH_2{=}CHF$. Fibers of Teflon® (fluorocarbon, made by E. I. du Pont de Nemours & Co.) are a typical example of such fluorine-containing fibers which can be used in this invention.

The water-swellable micaceous mineral used in this invention is represented by the following general formula $$W_{\frac{1}{3}\text{-}1.0}[X_{2.5\text{-}3.0}(Z_4O_{10})F_2]$$

wherein W is Na and/or Li, X is Li and/or Mg, Z is Si and/or Al, O is oxygen, and F is fluorine.

Examples include $Na[Mg_{2.5}(Si_4O_{10})F_2]$, $Li[Mg_2Li(Si_4O_{10})F_2]$, and $Na_{\frac{1}{3}}[Mg_{8/3}Li_{\frac{1}{3}}(Si_4O_{10})F_2]$.

Such a water-swellable micaceous mineral can be industrially synthesized, for example, by melting raw materials under atmospheric pressure. The product is called a water-swellable synthetic micaceous mineral.

When a finely divided powder of the water-swellable micaceous mineral is dipped in water, it swells and forms a sol. This phenomenon is believed to be attributed to the fact that by absorbing water into the interstices of the crystal layers, this mineral swells and is finally cleaved into an ultrafine powder, thereby forming a sol.

The sol has the property of solidifying when it is dried, or is put in an electrolytic solution such as an aqueous solution of NaOH or NaCl in a high concentration. But when it is again dipped in water, it swells and finally forms a sol.

When it is dipped in an aqueous solution of sodium chloride or sodium hydroxide of a high concentration, it scarcely forms a sol.

The water-swellable micaceous mineral has cating exchanging ability whether it is in the form of a fine powder, a swollen powder or a sol, or in the re-solidified state (film, particles, etc.). It is said that its exchanging capacity is 200 to 250 meq/100 g in the case of $W_{1.0}$ in the above general formula, and about 100 meq/100 g in the case of $W_{\frac{1}{3}}$.

The present inventors have found that when an aqueous solution of sodium chloride is electrolyzed by the diaphragm method using a diaphragm obtained by incorporating the water-swellable micaceous mineral in the fibrous base material, the diaphragm has good dimensional stability and increased strength and functions as a reinforcing material and the concentration of sodium hydroxide at the cathode can be increased while maintaining a high current efficiency without increasing the cell voltage.

Although it has not yet been fully known why the diaphragm of this invention produces such as effect, it is presumed that the cation exchangeability of the water-swellable micaceous mineral properly regulates the migration of ions.

Preferably, the water-swellable micaceous mineral is used in an amount of 5 to 50 parts by weight per 100 parts by weight of the fibrous base material.

It is presumed that when the fibrous base material is dispersed in an aqueous slurry of the micaceous mineral to produce a diaphragm, a part of the mineral is adsorbed in the form of fine particles to the fibrous base material, and the remainder remains in the liquid contained in the interstices of the fibers. On drying, the mineral remaining in the liquid becomes film-like aggregate and connects the fibers to one another or clogs the fine pores of the fibrous material.

When an aqueous slurry of the mineral is mixed with an aqueous solution of an electrolyte such as sodium hydroxide or sodium chloride and the fibrous base material is dispersed in the mixture to produce a diaphragm, or when the aqueous slurry of the mineral is first prepared and then mixed with a slurry obtained by dispersing the fibrous base material in a solution of sodium hydroxide and/or sodium chloride, the mineral exists as fine particles in the interstices of the fibrous base material and does not form a film upon drying.

As shown in the working examples given hereinbelow, there is no significant difference in performance whether the mineral forms a film or not.

A first preferred embodiment of the method of this invention comprises dispersing the fibrous base material in an aqueous slurry of the water-swellable micaceous mineral in which at least a part of the micaceous mineral is dispersed in the form of a sol, forming the dispersion into a sheet, and then drying the sheet.

For example, the water-swellable micaceous mineral is added to water (preferably, in a concentration of 0.01 to 1% by weight), and as required, the mixture is heated to convert at least a part of the mineral into a sol. A suitable amount of asbestos or a mixture of asbestos and fluorine-containing fibers is added to the sol and dispersed well to form an aqueous slurry. The aqueous slurry is then formed into a sheet on a porous plate or wire gauze as cathode by general sheet-forming methods. The resulting sheet is then dried at 70° to 400° C. It has been found that by this method, a film of the mineral is formed in the interstices among the fibers. It is presumed that when as above the fibrous base material is dispersed in an aqueous slurry of the micaceous mineral, a part of the mineral is adsorbed in the form of fine particles to the fibrous base material, and the remainder remains in the liquid contained in the interstices of the fibers. On drying, the mineral remaining in the liquid becomes a film-like aggregate and connects the fibers to each other or clogs the fine pores of the fibrous material.

A second preferred embodiment of the method of this invention comprises preparing a uniform dispersion of the fibrous base material in a mixture of an aqueous slurry of the water-swellable micaceous mineral in which at least a part of the micaceous mineral is dispersed in the form of a sol and an aqueous solution of sodium hydroxide and/or sodium chloride, then forming the dispersion into a sheet, and drying the sheet.

For example, an aqueous slurry of the water-swellable micaceous mineral in which at least a part of the mineral is dispersed in the form of a sol is prepared by the same procedure as in the first embodiment described above. Separately, a suitable amount of asbestos or a mixture of asbestos and fluorine-containing fibers is dispersed in an aqueous solution of sodium hydroxide (preferably in a concentration of 15 to 25% by weight), an aqueous solution of sodium chloride (preferably in a concentration of 20 to 25% by weight), or a mixed aqueous solution of sodium hydroxide and sodium chloride (preferably in a mixing ratio of 2:1 to 1:2, in a concentration of 15 to 20% by weight) to form an aqueous slurry. The two slurries are mixed to form a mixed slurry (preferably, the weight ratio of the micaceous mineral to the fibrous base material is 5 to 50%). The mixed slurry is formed into a sheet on a porous plate or wire gauze as a cathode by generally practiced sheet-forming methods. The sheet is then dried at a temperature of 70° to 400° C.

Alternatively, the second embodiment may be performed by adding sodium hydroxide and/or sodium chloride to the slurry of the water-swellable micaceous mineral in which at least a part of the micaceous mineral is dispersed in the form of a sol, adding the fibrous base material to the resulting mixture, stirring the mixture to form a uniform dispersion of the fibrous base material, forming the dispersion into a sheet, and drying the sheet.

When as in the second embodiment an aqueous slurry of the mineral is mixed with an aqueous solution of an electrolyte such as sodium hydroxide or sodium chloride and fibrous base material is dispersed in the mixture, or when the aqueous slurry of the mineral is first prepared and then mixed with a slurry obtained by dispersing the fibrous base material in a solution of sodium hydroxide and/or sodium chloride, the mineral exists as fine particles in the interstices of the fibrous base material, and does not form a film upon drying.

Experiments have shown however that the resulting diaphragms are feasible and do not differ significantly in performance whether the water-swellable micaceous mineral is in the form of a film or exists as fine particles.

According to still another embodiment of the method of this invention, the diaphragm of this invention can also be produced by impregnating a film or sheet of the fibrous base material with an aqueous slurry of the water-swellable micaceous mineral in which at least a part of the micaceous mineral is dispersed in the form of a sol, and then drying the impregnated film. Specifically, the aqueous slurry of the micaceous mineral is prepared by the same procedure as in the first embodiment of the method of this invention, and a diaphragm of the fibrous base material obtained by an ordinary sheet-forming method, or a diaphragm-including cathode obtained by forming the fibrous base material into a film integrally on a porous plate or wire gauze as a cathode is dipped in the resulting aqueous slurry. The aqueous slurry is thus impregnated fully in the diaphragm for a suitable period of time determined according to the material of the diaphragm, its thickness, etc. Then, the impregnated diaphragm is dried at a temperature of 70° to 400° C. It has been found that a film of the mineral is formed in the interstices of the fibers in the diaphragm obtained by this embodiment.

In the products obtained by the above embodiments of the method of this invention, a particulate or film-like connected structure is formed in the interstices of the fibers. In an electrolytic cell, this connected structure again swells but scarcely forms a sol.

The following examples specifically illustrate the present invention.

EXAMPLE 1

A mixture of a water-swellable synthetic micaceous mineral of the formula $Na[Mg_{2.5}(Si_4O_{10})F_2]$ ("DM CLEAN", a tradename for a product of Topy Industries, Ltd., Japan) and water was vigorously stirred to form a sol having a concentration of 2.8 g/liter. An amount, corresponding to 14 g/liter, of chrysotile asbestos (3T-700, a tradename for a product of Johns-Manville Company) was added. The mixture was stirred to form a slurry. From the resulting slurry, the mineral in an amount of 1.43 g/dm$^2$ and asbestos in an amount of 7.14 g/dm$^2$ were deposited by a pressure reduction method onto a wire gauze as a cathode. The resulting diaphragm was dried at 120° C. for 4 hours.

EXAMPLE 2

A diaphragm was produced in the same way as in Example 1 except that the concentration of the sol of the water-swellable synthetic micaceous mineral was changed to 1.4 g/liter and the amount of its deposition, to 0.71 g/dm$^2$.

EXAMPLE 3

A diaphragm was produced in the same way as in Example 1 except that the concentration of the chrysotile asbestos was changed to 19.6 g/liter, and the amount of its deposition, to 10 g/dm$^2$.

EXAMPLE 4

A mixture of chrysotile asbestos (3T-700, Johns-Manville Company) and fluorine-containing fibers of polytetrafluoroethylene (melting point: 327° C.) in a weight ratio of 10:0.8 was put in a 25% by weight aqueous solution of sodium hydroxide to a concentration of 36 g/liter to form an aqueous slurry. The aqueous slurry was mixed with a sol (3.0 g/liter) of the water-swellable synthetic micaceous mineral formed by the same procedure as in Example 1 at a volume ratio of 3:5. The mixture was well stirred, and subjected to sheet formation on a cathode wire gauze in the same manner as in Example 1, followed by drying at 360° C. for 1 hour. The amount of the fibrous base material deposited was 7.65 g/dm$^2$, and the amount of the water-swellable synthetic micaceous mineral deposited was 1.06 g/dm$^2$.

COMPARATIVE EXAMPLE 1

Chrysotile asbestos (3T-700, Johns-Manville Company) was dispersed in a 20% by weight aqueous solution of sodium hydroxide to a concentration of 34 g/liter. The dispersion was subjected to sheet formation on a cathode wire gauze in a customary manner, and then dried at 120° C. for 4 hours. The amount of asbestos deposited was 13.6 g/dm$^2$.

COMPARATIVE EXAMPLE 2

A diaphragm was produced in the same way as in Comparative Example 1 except that the amount of asbestos deposited was changed to 15.0 g/dm$^2$.

COMPARATIVE EXAMPLE 3

A diaphragm was produced in the same way as in Comparative Example 1 except that the amount of asbestos deposited was changed to 10.7 g/dm$^2$.

COMPARATIVE EXAMPLE 4

A diaphragm was produced in the same way as in Comparative Example 1 except that the amount of asbestos deposited was changed to 8.5 g/dm$^2$.

COMPARATIVE EXAMPLE 5

A diaphragm was produced in the same way as in Comparative Example 1 except that the same mixed fibrous base material as used in Example 4 was used instead of asbestos, the amount of the mixed fibrous base material deposited was changed to 1.20 g/dm$^2$, and the drying of the diaphragm was carried out at 360° C. for 1 hour.

EXAMPLE 5

A mixture of the same water-swellable synthetic micaceous mineral as used in Example 1 and water was stirred to form a sol, and then sodium hydroxide was added to form a mixed slurry containing 3.3 g/liter of the mineral and 25% by weight of sodium hydroxide. The same chrysotile asbestos as used in Example 1 was added in an amount corresponding to 21.7 g/liter, and the mixture was stirred to form a uniform slurry. From the resulting slurry, the mineral was deposited in an amount corresponding to 1.6 g/dm$^2$ and asbestos, in an amount corresponding to 11 g/dm$^2$, both on a cathode by a pressure reducing method. The resulting diaphragm was dried at 120° C. for 4 hours.

EXAMPLE 6

A diaphragm was produced under the same conditions as in Example 5 except that $Na_{\frac{1}{3}}[Mg_{8/3}Li_{\frac{1}{3}}(Si_4O_{10})F_2]$ ("Hectorite", a tradename for a product of Topy Industries, Ltd., Japan) was used as the water-swellable synthetic micaceous mineral.

ELECTROLYSIS EXPERIMENT

An aqueous solution of sodium chloride was continuously electrolyzed for 2 weeks under the following conditions using each of the diaphragms obtained in Examples 1 to 6 and Comparative Examples 1 to 5. The results are shown in Table 1.

(1) Composition of the aqueous sodium chloride solution: NaCl 310 g/liter, $Ca^{++}$ 3 mg/liter, $Mg^{++}$ 0.3 mg/liter (2) Difference in head between the catholyte solution and the anolyte solution: 50 cm (3) Bath temperature of the electrolytic cell: 70° C.

(4) Current density 20 A/dm$^2$

The relation between the concentration of sodium hydroxide and the current efficiency in Table 1 is plotted in the accompanying drawing in which curve 1 shows the relation obtained in Examples and curve 2, the relation obtained in Comparative Examples. Table 1 and the accompanying drawing clearly demonstrate the superiority of the Examples to the Comparative Examples.

After the end of the electrolysis, the pH at the anode side of the diaphragms was examined by means of a pH paper. It was found that while the diaphragms of Examples 1 to 5 were neutral at the anode side, the anode side of the diaphragms obtained in Comparative Examples 1 to 5 were alkaline, showing a marked difference. This marked difference is presumably because in the diaphragms of this invention, the water-swellable micaceous minerals were satisfactorily dispersed, and thus prevented the back migration of $OH^-$ generated on the cathode side.

TABLE 1

| | | | Example | | | | | |
|---|---|---|---|---|---|---|---|---|
| | | | 1 | 2 | 3 | 4 | 5 | 6 |
| Sheet-forming conditions | | Fibrous base material (g/dm$^2$; cathode) | 7.14 | 7.14 | 10 | 7.65 | 11 | 11 |
| | | Micaceous mineral (g/dm$^2$; cathode) | 1.43 | 0.71 | 1.43 | 1.06 | 1.6 | 1.6 |
| | | Drying (°C. × hr) | 120 × 4 | 120 × 4 | 120 × 4 | 360 × 1 | 120 × 4 | 120 × 4 |
| Electrolysis | Conditions | Current density (A/dm$^2$) | 20 | 20 | 20 | 20 | 20 | 20 |
| | | Cell voltage (V) | 3.20 | 3.15 | 3.30 | 3.08 | 3.18 | 3.30 |
| | | Bath temperature of the cell (°C.) | 70 | 70 | 70 | 70 | 70 | 70 |
| | Results | NaOH concentration (g/l) | 160 | 130 | 208 | 140 | 160 | 160 |
| | | Purity of $Cl_2$ gas (vol %) | 98 | 99.2 | 94.2 | 97.9 | 98.0 | 97.6 |
| | | Amount (vol %) of $H_2$ gas in $Cl_2$ gas | not detected | not detected | not detected | not detected | not detected | not detected |
| | | Current efficiency at the cathode (%) | 96.0 | 99.0 | 90.8 | 96.9 | 96.0 | 93.0 |
| | | Dimensional stability of the diaphragm | Good | Good | Good | Good | Good | Good |

| | | | Comparative Example | | | | |
|---|---|---|---|---|---|---|---|
| | | | 1 | 2 | 3 | 4 | 5 |
| Sheet-forming conditions | | Fibrous base material (g/dm$^2$; cathode) | 13.6 | 15.0 | 10.7 | 8.5 | 12.0 |
| | | Micaceous mineral (g/dm$^2$; cathode) | — | — | — | — | — |
| | | Drying (°C. × hr) | 120 × 4 | 120 × 4 | 120 × 4 | 120 × 4 | 360 × 1 |
| Electrolysis | Conditions | Current density (A/dm$^2$) | 20 | 20 | 20 | 20 | 20 |
| | | Cell voltage (V) | 3.30 | 3.40 | 3.25 | 3.0 | 3.1 |
| | | Bath temperature of the cell (°C.) | 70 | 70 | 70 | 70 | 70 |
| | Results | NaOH concentration (g/l) | 110 | 150 | 130 | Continued operation | 120 |
| | | Purity of $Cl_2$ gas (vol %) | 98.8 | 94.5 | 96.0 | 98.0 | |
| | | Amount (vol %) of $H_2$ gas in $Cl_2$ gas | 0.2–0.3 | 0.1 | 0.1–0.2 | failed because of a high $H_2$ content in $Cl_2$ | 0.13 |
| | | Current efficiency at the cathode (%) | 97.6 | 91.0 | 94.8 | | 95.9 |
| | | Dimensional stability of the diaphragm | Good | Good | Good | Perforated | Good |

EXAMPLE 7

As shown above, when the diaphragm of this invention is used, the current efficiency is not reduced even at a high NaOH concentration. Since this is due presumably to the cation exchangeability of the diaphragm, cation exchangeability was measured by the following method.

A diaphragm (1 dm$^2$) was prepared from the same asbestos and water-swellable micaceous mineral as used in Example 1 while adjusting the amounts of asbestos and mineral deposited to 8.3 g and 0.83 g respectively per dm$^2$. The diaphragm was subjected to an operation consisting of the steps of (1) passing 1 liter of deionized water through the diaphragm, (2) then passing 1 liter of water whose pH was adjusted to 3 by addition of HCl through the diaphragm, (3) then passing 1 liter of deionized water, and (4) then passing 1 liter of water whose pH was adjusted to 11 by addition of NaOH through the diaphragm. This operation was repeated 9 times. In the ninth cycle of operation, the pH values of the filtrates were examined in these four steps, and the following results were obtained.

| Step | pH of the filtrate |
|---|---|
| (1) | 8.8 |
| (2) | 7.4 |
| (3) | 8.4 |

-continued

| Step | pH of the filtrate |
|---|---|
| (4) | 9.1 |

It is seen from the results that the diaphragm used in the experiment had an ion-exchanging capacity of 1 meq, and performed ion exchange to an extent of 1.2 meq. per gram of the mineral.

What we claim is:

1. A diaphragm for electrolysis, said diaphragm comprising a fibrous base material of asbestos or a mixture of asbestos and fluorine-containing fibers wherein in the interstices of said base material, a water-swellable micaceous mineral represented by the following general formula is present:

$$W_{\frac{1}{2}-1.0}[X_{2.5-3.0}(Z_4O_{10})F_2]$$

wherein W is Na and/or Li, X is Li and/or Mg, Z is Si and/or Al, O is oxygen and F is fluorine.

2. The diaphragm of claim 1 wherein said micaceous mineral exists in the form of fine particles.

3. The diaphragm of claim 1 wherein a part of said micaceous mineral exists in the form of a film.

* * * * *